US009486671B2

(12) United States Patent
Shau

(10) Patent No.: US 9,486,671 B2
(45) Date of Patent: Nov. 8, 2016

(54) SWIMMING GOGGLES

(76) Inventor: David Shau, Palo Alto, CA (US)

( * ) Notice: Subject to any disclaimer, the term of this patent is extended or adjusted under 35 U.S.C. 154(b) by 547 days.

(21) Appl. No.: 13/569,608

(22) Filed: Aug. 8, 2012

(65) Prior Publication Data

US 2014/0041106 A1 Feb. 13, 2014

(51) Int. Cl.
*G02B 21/00* (2006.01)
*A63B 33/00* (2006.01)

(52) U.S. Cl.
CPC ..... *A63B 33/00* (2013.01); *A63B 2225/12* (2013.01)

(58) Field of Classification Search
USPC ..... 359/600, 629, 630, 815, 816, 480, 481; 351/41, 43, 50; 2/15, 410, 425–440, 2/445, 446
See application file for complete search history.

(56) References Cited

U.S. PATENT DOCUMENTS 1,683,505 A * 9/1928 Walker ..... 2/433
3,944,345 A 3/1976 Decorato
4,286,340 A 9/1981 Lathrop
4,647,165 A * 3/1987 Lewis ..... 351/59
4,792,223 A * 12/1988 Axelbaum ..... G02C 7/14 351/158
4,804,261 A * 2/1989 Kirschen ..... 351/158
5,173,720 A * 12/1992 Lee ..... G02C 7/14 351/158
5,258,785 A * 11/1993 Dawkins, Jr. ..... A61F 9/029 351/158
5,561,480 A * 10/1996 Capes ..... G02C 5/001 351/45
5,581,822 A 12/1996 Tagyo
5,764,334 A * 6/1998 Berke ..... 351/50
6,006,367 A * 12/1999 Webster ..... 2/430
6,065,832 A * 5/2000 Fuziak ..... 351/50
7,062,796 B1 * 6/2006 Dixon ..... 2/426
2006/0010587 A1 1/2006 Yokota

FOREIGN PATENT DOCUMENTS

CN 201105124 Y * 8/2008 ..... A63B 33/00
FR 2630653 A1 * 11/1989 ..... A63B 33/00

* cited by examiner

*Primary Examiner* — Bumsuk Won
*Assistant Examiner* — Balram Parbadia

(57) ABSTRACT

Swimming goggles allow a swimmer to see the end of the pool without moving their head while swimming in backstroke. Using a light reflector, a swimmer can view through a backstroke viewing window to view along the backstroke moving direction. Swimmers wearing the goggles can therefore reduce the chance for injury while helping backstroke swimming efficiency.

14 Claims, 5 Drawing Sheets

SWIMMING GOGGLES

BACKGROUND OF THE INVENTION

The present invention relates to swimming goggles, and more particularly to backstroke swimming goggles.

Swimming is a sport that keeps people in great shape. Swimming exercises most of the body's muscles, and swimming can even save one's life. For most of competitive sports, it is almost guaranteed that people will eventually get hurt by sport injuries. In comparison, swimming is a sport that rarely causes serious injury. However, like me, most swimmers have bumped their head at the end of the pool while swimming backstroke. While at full sprinting speed, this type of injury may even result in minor concussions, and is also quite painful. It is desirable to design swimming goggles that allow swimmers to see the end of the pool without moving their head while swimming in backstroke. Also, backstroke swimmers often swim in a curvy zigzag path in their lane instead of a simple direct straight line. If the swimmer swims in a zigzag path, then the distance that they swim will be longer, and it also makes them look bad. It is desirable for a swimmer to see the sights behind them while swimming backstroke, so that they may line up their position, thus allowing the swimmer to swim in a straight line. It is also desirable to have swimming goggles that can help swimmers maintain proper head position while swimming backstrokes.

Decorato in U.S. Pat. No. 3,944,345 disclosed a swimming goggle equipped with special lens that attaches onto the front of the eye sockets, increasing the user's lateral vision. It, however, does not enable the ability to see behind his or herself, and does not provide wide enough visual range to support backstroke.

Lathrop in U.S. Pat. No. 4,286,340 disclosed a pair of comfortable competition goggles with anti fog washing, watertight fits that enhance the eyesight, and improved forward vision that allows the user to see the wall without lifting their head while swimming the crawl, breast, and butterfly strokes. The swimming goggles, however, does not improve backwards vision, and cannot benefit the ability to see the end of the pool without moving their head while swimming in backstroke.

Tagyo in U.S. Pat. No. 5,581,822 disclosed an attractively shaped pair of goggles that provide watertight vision, and also allow the user to swim faster due to its smooth single large lens. It, however, does not provide the ability to see the wall while swimming backstroke.

Yokota in U.S. Patent Application No. 20060010587 disclosed a pair of goggles that use a contact section that attaches to the area around the eye in the eye socket, therefore, improving the user's field vision. The goggles also prevent light refraction that may cause discomfort to the owner. These goggles may enhance the peripheral vision while swimming backstroke, but it does not give a clear vision of the wall; the swimmers still need to change their normal head positions to see the wall. It also does not use a light reflector.

SUMMARY OF THE PREFERRED EMBODIMENTS

A primary objective of the preferred embodiments is, therefore, to provide swimming goggles that allow the user to see behind him or her without changing their normal head position while swimming backstroke. This will reduce the chance of injury, since they can now see where the wall is.

Another primary objective is to prevent the swimmer from swimming in a zigzag manner when they swim across the pool in their lane. This will allow the swimmer to go faster, and prevent the user from crashing into the lane lines. These and other objectives are assisted by providing swimming goggles with backstroke viewing windows at the eye sockets.

While the novel features of the invention are set forth with particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 1(*b*) shows the swimming goggle in FIG. 1(*a*) while the light blocking cover of the backstroke viewing window is closed;

FIG. 1(*c*) shows a goggle without a light blocking cover on the backstroke viewing window;

FIG. 1 (*d*) shows a goggle with backstroke viewing windows on both eye sockets;

FIG. 3(*b*) shows a simplified view of a user who is swimming backstroke on his back;

DETAILED DESCRIPTION OF THE PREFERRED EMBODIMENTS

Figure 1A:
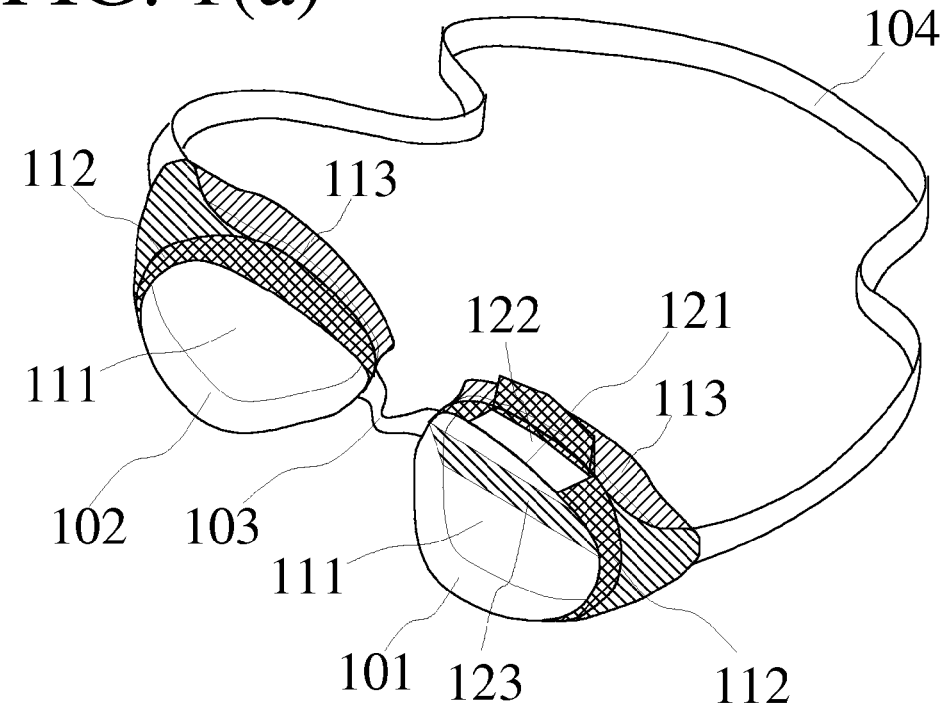
FIG. 1(*a*) shows one example of the swimming goggles of the present invention that has a backstroke viewing window on one eye socket.
Figure 1B:
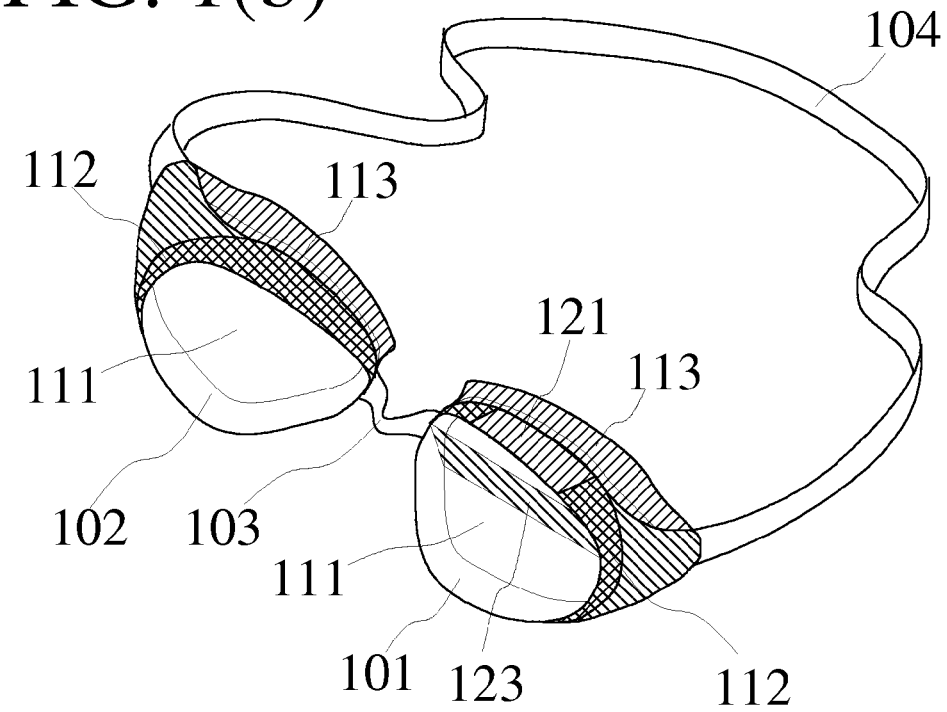
Figure 1C:
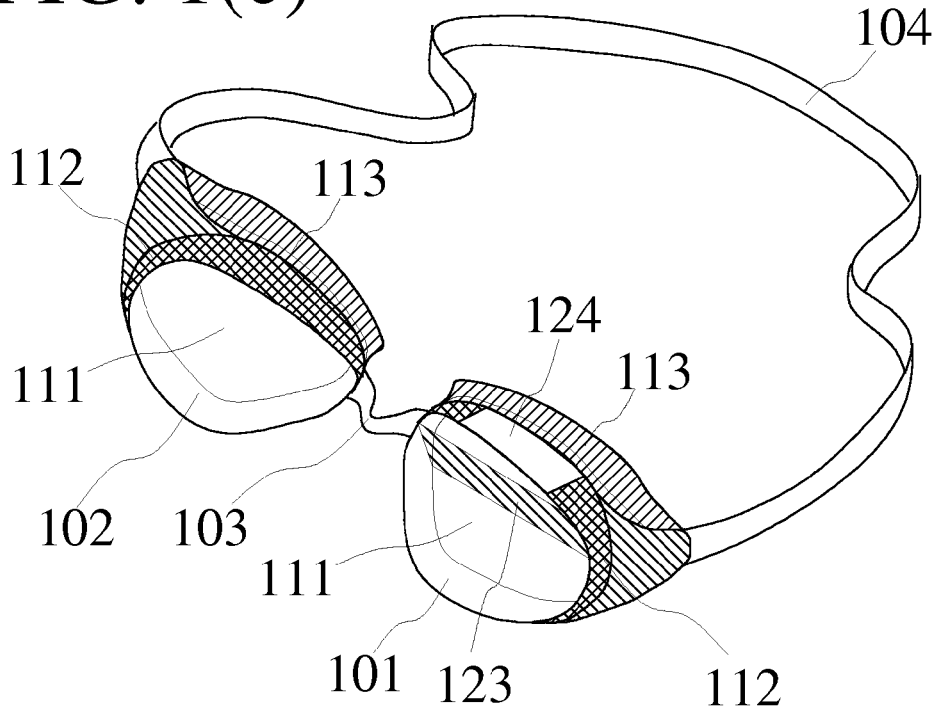
Figure 1D:
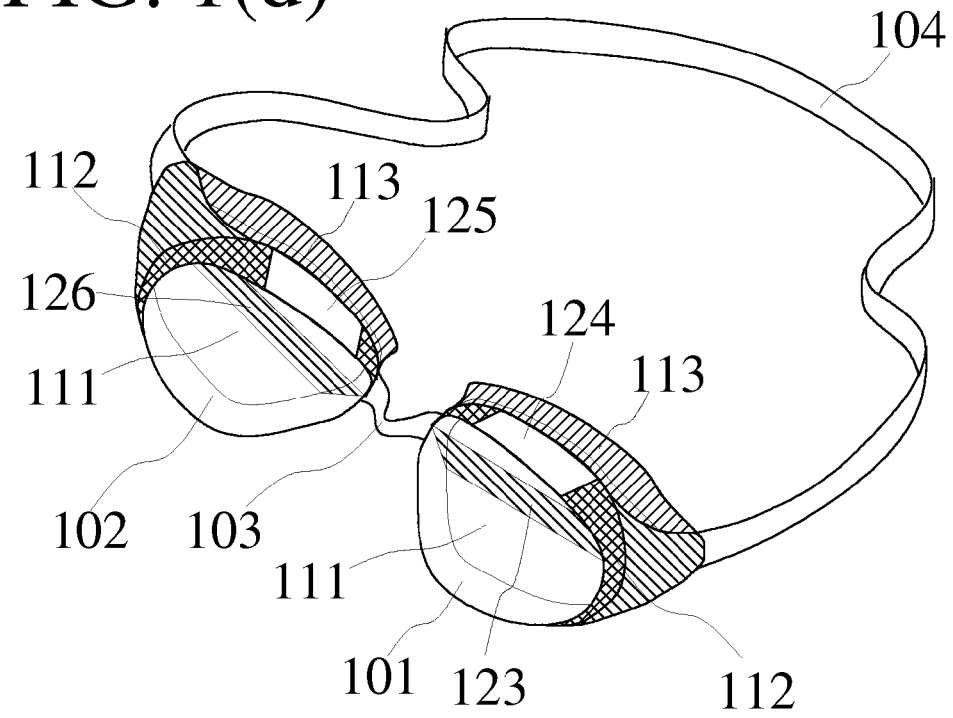

FIGS. 1(*a-d*) show examples of the goggles of the present invention. The goggles in these examples comprise two eye sockets (101,102) connected by a nosepiece (103) and a head strap (104). Each eye socket (101,102) has a forward viewing window (111) that is mounted on a suction socket (113). Typically, the forward viewing window (111) is made of transparent plastic plate, and the suction socket (113) is made of rubber or plastic. The suction socket (113) sticks onto swimmer's eyes, creating a water tight seal while providing a space between the eye and the forward viewing window (113), allowing clear under-water vision. These structures are similar to those used in conventional swimming goggles. In addition, the examples in FIGS. 1(*a-d*) contain structures that are designed to allow the swimmer to see the end of the pool without moving their head while swimming in backstroke. For example, FIGS. 1(*a, b*) illustrate a goggle that has a backstroke viewing window (122) opened at the upper side (112) of the eye socket. A backstroke viewing window, by definition, is a transparent window on the eye socket of a swimming goggle that faces upward direction while the swimmer wearing the goggle is standing upright so that it faces the end of swimming pool when the swimmer is in normal head position while swimming backstroke. A backstroke viewing window is typically nearly vertical to the front viewing window. In this example, the backstroke viewing window (122) is made of transparent plastic. To prevent unwanted peripheral lights, the backstroke viewing window (122) can be covered with a light blocking cover (121). FIG. 1(*a*) illustrates the situation when the light blocking cover (121) of the backstroke viewing window (122) is opened, and FIG. 1(*b*) illustrates the situation when the light blocking cover (121) is closed. In this example, a light reflector (123) is placed inside the eye socket (101), as illustrated in FIGS. 1(*a, b*). In this example, the light reflector (123) is a transparent plastic plate supporting the functions of a half-mirror. A half-mirror, by definition, is a light reflector that is partially transparent and partially reflecting. In this example, the index of reflection of the light reflector (123) is adjusted in such way that the reflected view is more dominating than the transparent view. When the light blocking cover (121) of the backstroke viewing window (122) is opened, as shown in FIG. 1(*a*), the light that travels through the backstroke viewing window (122) is reflected by the light reflector (123), allowing the swimmer to see the end of the pool without moving their head while swimming in backstroke. When the light blocking cover (121) of the backstroke viewing window (122) is closed, as shown in FIG. 1(*b*), almost no light would come from the upward direction so that the swimmer would see views at the front direction through the half-mirror light reflector (123).

While the preferred embodiments have been illustrated and described herein, other modifications and changes will be evident to those skilled in the art. For example, the light reflector (123) can be a mirror instead of a half-mirror. For another example, FIG. 1(*c*) shows another goggle that has a backstroke viewing window (124) without a light blocking cover. This goggle can be manufactured at lower cost, but users may see unwanted lights from upward direction. Another example in FIG. 1(*d*) shows a goggle with backstroke viewing windows (124, 125) and light reflectors (123, 126) in both eye sockets (101,102). This goggle allows better upward vision because both eyes are now able to see the same reflection, but front view will be less clear. It is to be understood that there are many other possible modifications and implementations so that the scope of the invention is not limited by the specific embodiments discussed herein.

Figure 2A:
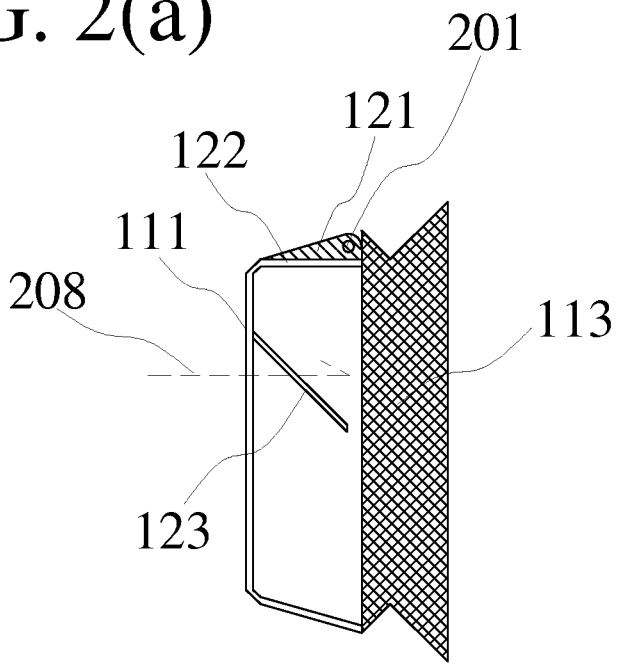
FIG. 2(*a, b*) are cross-section views of an eye socket that can automatically switch the position of the light blocking cover of the backstroke viewing window.
Figure 2B:
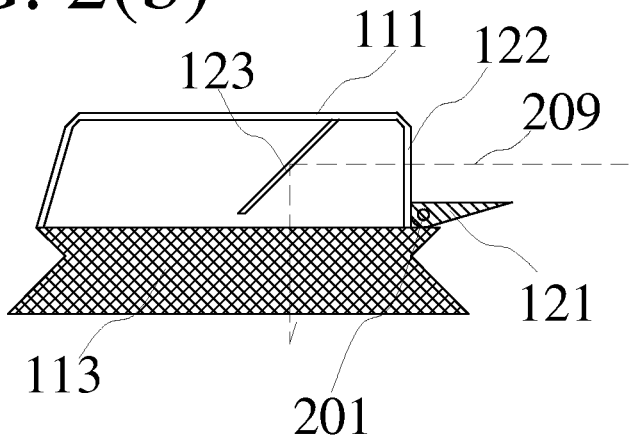
Figure 3A:
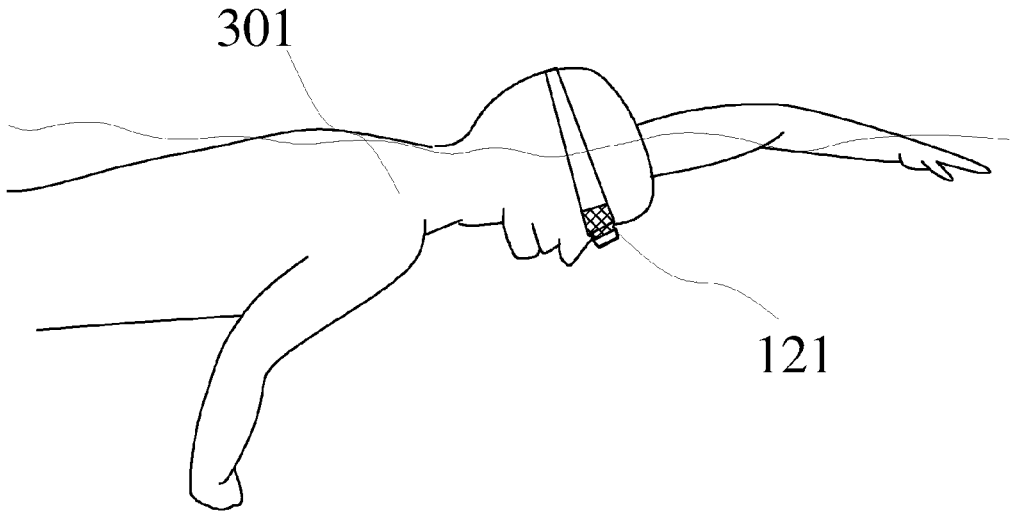
FIG. 3(*a*) shows a simplified view of a user who is swimming freestyle on his front.
Figure 3B:
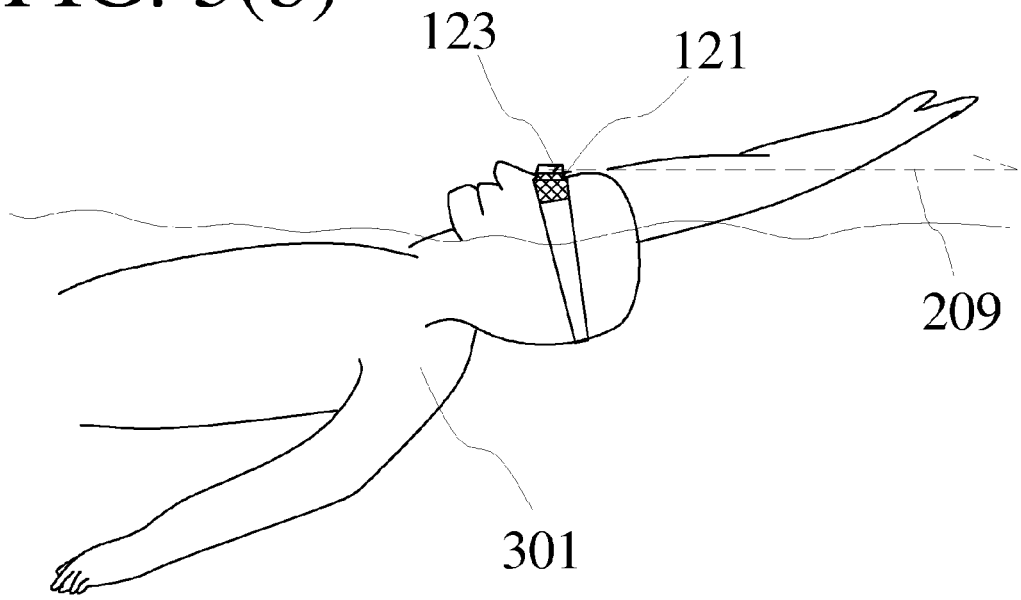

The light blocking cover (121) of the backstroke viewing window (122) shown in FIGS. 1(*a, b*) may be opened or closed manually. A swimmer can open the light blocking cover while swimming backstroke, and close it while swimming other strokes. While swimming melody, a swimmer needs to swim backstroke and other strokes. Flipping the light block cover while swimming can be troublesome. It is desirable to open or close the light blocking cover (121) automatically according to the stroke the swimmer is swimming. FIGS. 2(*a-b*) show cross-section views of an eye socket that can open or close the light blocking cover (121) automatically. In this example, the light blocking cover (121) is designed to rotate around a rotation axis (201). When the socket is at a position as illustrated in FIG. 2(*a*), the light blocking cover (121) is closed due to gravity. Under this situation, the light (208) passes directly through the half mirror (123) allowing the user to see what they would normally see while facing forward. Due to gravity, the light blocking cover (121) is also closed when the eye socket is facing downward. FIG. 3(*a*) illustrates the situation when a swimmer (301) wearing the goggle is swimming freestyle. Under this situation, the light blocking cover (121) of the backstroke viewing window is closed so that the swimming goggle functions as a conventional goggle. While swimming backstroke, the eye socket would face upward as illustrated by FIG. 3(*b*) and by the cross section diagram in FIG. 2(*b*). At this position, the light blocking cover (121) would rotate backward along the rotation axis (201) by gravity, opening the backstroke viewing window (122) as illustrated in FIG. 2(*b*). The light (209) through the opened window (122) is reflected by the light reflector (123), allowing the swimmer (301) to see the end of the pool without moving his head while swimming in backstroke.

While the preferred embodiments have been illustrated and described herein, other modifications and changes will be evident to those skilled in the art. It is to be understood that there are many other possible modifications and implementations so that the scope of the invention is not limited by the specific embodiments discussed herein. For example, the light reflector also can be automatically switched into position as shown by the cross-section diagrams in FIGS. 4(*a-b*).

Figure 4A:
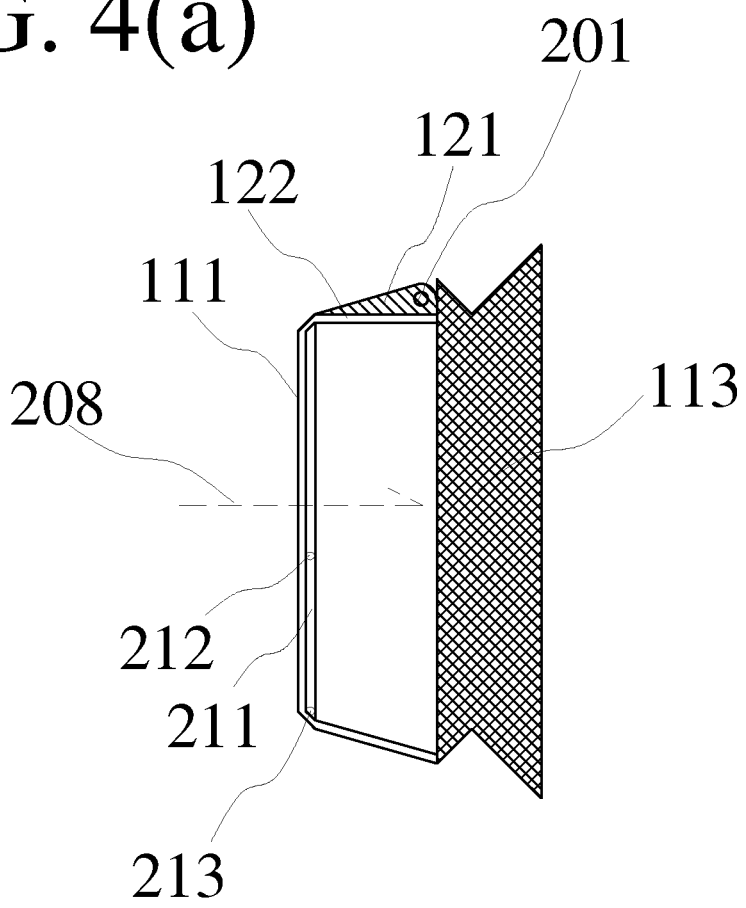
FIG. 4(*a, b*) are cross-section views of an eye socket that can automatically switch the positions of the light blocking cover and the light reflector.
Figure 4B:
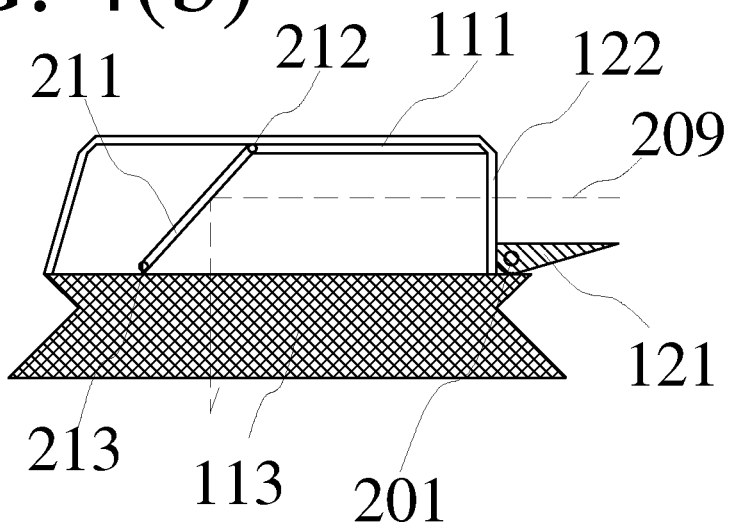

The eye socket shown in FIGS. 4(*a-b*) is similar to the eye socket shown in FIGS. 2(*a,b*) except that it has a light reflector (211) that can rotate against a rotation axis (212). A weight (213) is placed near the end of the light reflector (211) so that its position can be switched by gravity. When the socket is at a position illustrated in FIG. 4(*a*), the light reflector (211) is pulled by gravity to be in contact with the front viewing window (111) and functions as part of the front viewing window. Under this situation, the eye socket behaves as a conventional eye socket. Due to gravity, the position of this light reflector (211) would remain the same while the swimmer is swimming freestyle, breast, or butterfly strokes. While swimming backstroke, the eye socket would face upward, and the light reflector (211) would fall down due to gravity, as shown in FIG. 4(*b*). The light (209) through the opened backstroke viewing window (122) is reflected by the light reflector (211), allowing the swimmer to see the end of the pool without moving their head while swimming in backstroke.

The preferred embodiments of the present invention provide swimming goggles that allow the user to see the end of swimming pool without changing normal head position while swimming backstroke. The chance of injury is reduced because backstroke swimmers can now see where the wall is. The backstroke swimmer also can adjust swimming direction by vision to swim in straight line to achieve better time. These and other objectives are achieved by opening backstroke viewing windows at the eye sockets of swimming goggles. A light blocking cover can be used to prevent unwanted light going through the backstroke viewing window. The light blocking cover can be operated manually or automatically. A light reflector is typically used with the backstroke viewing window. This light reflector can be a half mirror or a full mirror. The light reflector also can be designed to change position automatically according the stroke the swimmer is swimming.

While specific embodiments of the invention have been illustrated and described herein, it is realized that other modifications and changes will occur to those skilled in the art. It is therefore to be understood that the appended claims are intended to cover all modifications and changes as fall within the true spirit and scope of the invention.

What is claimed is:

1. A swimming goggle comprising:

an eye socket having a transparent forward viewing window attached to a goggle frame wherein the goggle frame further comprises a backstroke viewing window opened on a top portion of the goggle frame disposed away from the transparent forward viewing window; and a position-switchable light blocking cover attached to an edge of the backstroke viewing window and is flippable with respect to the edge of the backstroke viewing window wherein the position-switchable light blocking cover is flipped to an open position to uncover the backstroke viewing window when a swimmer wearing the goggle is swimming in a backstroke orientation with the transparent forward viewing window facing an upward orientation, and the position-switchable light blocking cover is flipped to a close position to cover the backstroke viewing window when a swimmer wearing the goggle is swimming freestyle with the transparent forward viewing window facing a downward orientation.

2. The swimming goggle in claim 1 wherein:

the position-switchable light blocking cover is flipped to a close-position to cover the backstroke viewing window while the swimmer wearing the swimming goggle is swimming with the transparent forward viewing window facing sideward orientation.

3. The swimming goggle in claim 1 wherein:

the position-switchable light blocking cover is automatically flipped to an open-position to uncover the backstroke viewing window while the swimmer wearing the swimming goggle is swimming in the backstroke orientation.

4. The swimming goggle in claim 1 wherein:

the position-switchable light blocking cover is automatically flipped to an open-position by a gravity force acting on a weight attached to the position-switchable light blocking cover to uncover the backstroke viewing while the swimmer wearing the swimming goggle is swimming in the backstroke orientation.

5. The swimming goggle in claim 1 further comprises:

a light reflector to reflect the light coming through the backstroke viewing window into an eye of the swimmer wearing the swimming goggle while the swimmer is swimming in the backstroke orientation.

6. The swimming goggle in claim 5 wherein:

the light reflector comprises a half-mirror.

7. The swimming goggle in claim 5 wherein:

the light reflector is adjustable to change positions with respect to the back stroke viewing window depending on whether the swimmer wearing the swimming goggle is swimming in the backstroke orientation or not.

8. The swimming goggle in claim 5 wherein:

the light reflector is adjustable automatically to change positions with respect to the back stroke viewing window depending on whether the swimmer wearing the swimming goggle is swimming in the backstroke orientation or not.

9. The swimming goggle in claim 5 wherein:

the light reflector is adjustable automatically to change positions with respect to the back stroke viewing window by a gravity force acting on a weight that is attached to the light reflector depending on whether the swimmer wearing the swimming goggle is swimming in the backstroke orientation or not.

10. A swimming goggle comprising:

an eye socket having a transparent forward viewing window attached to a goggle frame; and a position-switchable light reflector to switch to different positions with respect to the transparent forward viewing window depending on whether or not the swimmer wearing the goggle is swimming backstroke, wherein the position-switchable light reflector is flipped automatically to reflect an incident light coming from one end of a swimming pool into an eye of the swimmer wearing the goggle while the swimmer wearing the swimming goggle is swimming in the backstroke orientation with the transparent forward viewing window facing an upward orientation, and the position-switchable light reflector is flipped automatically to a position where an incident light coming from the end of a swimming pool does not reflect into an eye of the swimmer wearing the goggle when the swimmer is swimming freestyle with the transparent forward viewing window facing a downward orientation.

11. The swimming goggle of claim 10 wherein:

the position-switchable light reflector comprises a half-mirror.

12. The swimming goggle of claim 10 further comprising:

a backstroke viewing window opened on a top portion of the goggle frame disposed away from the transparent forward viewing window and is covered by a position-switchable light blocking cover attached to an edge of the backstroke viewing window and is flippable with respect to the edge of the backstroke viewing window; and the position-switchable light blocking cover is flipped to an open position to uncover the backstroke viewing window and the position-switchable light reflector is adjustable to reflect the incident light coming from the backstroke viewing window into the eye of the swimmer wearing the swimming goggle when swimming in a backstroke orientation with the transparent forward viewing window facing an upward orientation.

13. The swimming goggle of claim 10 wherein:

the position-switchable light reflector is adjustable automatically to reflect the incident light coming from an end of a swimming pool into the eye of a swimmer wearing the swimming goggle when swimming in a backstroke orientation.

14. The swimming goggle of claim 10 wherein:

the position-switchable light reflector is adjustable automatically by a gravity force acting on a weight that is attached to the light reflector to reflect the incident light coming from an end of a swimming pool into the eye of a swimmer wearing the swimming goggle when swimming in a backstroke orientation.

* * * * *